United States Patent [19]

Cardiff

[11] 4,412,480

[45] Nov. 1, 1983

[54] DIRECTIONAL OUTLET ASSEMBLY

[76] Inventor: Raymond S. Cardiff, 40 Carnaby St., Macgregor Queensland, Australia

[21] Appl. No.: 298,413

[22] Filed: Sep. 1, 1981

[30] Foreign Application Priority Data

Sep. 3, 1980 [AU] Australia ..... PE 5387

[51] Int. Cl.[3] ..... F24F 13/06

[52] U.S. Cl. ..... 98/40 D; 98/40 V; 98/40 VM; 98/41 R

[58] Field of Search ..... 98/40 R, 40 D, 40 V, 98/40 VM, 41 R, 110, 116, 121 A

[56] References Cited

U.S. PATENT DOCUMENTS

| | | | |
|---|---|---|---|
| 926,183 | 6/1909 | Guy | 126/288 |
| 2,624,265 | 1/1953 | Mader | 98/116 X |
| 2,847,729 | 8/1958 | Zingone | 98/40 VM |
| 2,901,961 | 9/1954 | Cotts | 98/40 VM |
| 3,303,772 | 2/1967 | Wheatley | 98/41 R |
| 4,020,752 | 5/1977 | Stephan | 98/40 D |
| 4,147,095 | 4/1979 | Jacobs | 98/40 VM |
| 4,187,878 | 2/1980 | Hughey | 137/601 |

FOREIGN PATENT DOCUMENTS

| | | | |
|---|---|---|---|
| 73283 | 10/1951 | Denmark | 98/41 R |

*Primary Examiner*—Albert J. Makay
*Assistant Examiner*—Harold Joyce
*Attorney, Agent, or Firm*—Sughrue, Mion, Zinn, Macpeak, and Seas

[57] ABSTRACT

A directional air outlet assembly is provided which has a plurality of outlet grills adapted to direct air in different directions. Suitably, the outlet grills are adjustable to enable the air flow therethrough to be selectively varied.

9 Claims, 9 Drawing Figures

DIRECTIONAL OUTLET ASSEMBLY

This invention relates to an improved directional air outlet assembly or shutter for use with air flow generating apparatus such as fans, air blowers or air conditioners.

Hitherto such louvre assemblies have been deficient in that although they shielded the air flow from being directly thrust or directed at a particular location or a user they were not versatile in nature and were either fixed or the louvres were capable of being pivoted in one direction only relative to their surrounding support frame. Thus if say a user shifted location the user might then be in a position shielded from direct benefit from the air flow generating apparatus, or possibly the new position may be subject to an uncomfortably high level of air flow.

It is therefore an object of the invention to provide a directional outlet assembly for use with air flow generating apparatus that is capable of achieving a selective multi-directional air flow whereby the air flow may reach all of the most parts or even a desired part of a room or area exposed to the air flow through the louvre assembly. Other objects and advantages of the invention will hereinafter become apparent.

With the foregoing and other objects in view, this invention resides broadly in a directional air outlet assembly including a support frame supporting a plurality of blade assemblies each having a multiplicity of blades which in use deflect air flow through the respective said blade assembly to exit therefrom in a respective selected direction and at least one said blade assembly being provided with flow adjustment means.

The support frame may have any suitable shape such as round but is preferably rectangular or square. It is suitably formed from elongate members which are desirably aluminium extrusions.

Each blade assembly suitably comprises a plurality of louvre blades having one or more support members or connection members such as a bar or rail which extends across the louvre blades which are all substantially parallel to each other. The connecting bar may be attached to each associated louvre blade by a suitable attachment plate which is preferably angles thus forming two flanges which are normal to each other with one flange being bolted to an adjacent louvre blade and the other flange being pivotally attached to an adjacent connecting bar.

The support frame may also include one or more cross members which may thus form the support frame into a plurality of sub-frames whereby each sub-frame may support a respective louvre assembly. In this particular embodiment each louvre blade of a louvre assembly may be pivotally attached to an associated member of a sub-frame in any appropriate manner.

While the arrangement referred to above describes each louvre blade as being pivotally attached to a sub-frame member this is not essential and suitably pivotal attachment means may be provided for attaching each louvre assembly to the support frame or sub-frame.

The actuating means for pivoting the respective louvre assemblies in one form may include an actuating bar or rail pivotally attached to an associated connecting bar.

Preferably there is provided within the support frame an access aperture which is preferably located in the central region thereof and is suitably provided with a cover plate which is releasably attached thereto or pivotally attached to the support frame. The access aperture may be rectangular in shape and may be bounded by walls each having a top edge or top edge retianing flange. In this arrangement the actuating bar may be provided with a plurality of spaced slots or notches in its bottom edge or surface which may engage with the retaining flange or top edge so as to retain a particular louvre assembly in a particular orientation or setting. When it is desired to change to a new setting, the cover plate of the access aperture may be removed or released from the closed position so that the actuating bar may be removed from the original setting to a new setting manually (i.e. by hand).

However, it will be appreciated that the louvre assembly may be moved from an original setting to a new setting in any desired manner such as by remote control and that any appropriate retaining means may be used to retain the louvre assembly in a desired setting.

In order that the invention may be more readily understood and put into practical effect, reference will now be made to preferred embodiments of the invention as shown in the attached drawings wherein.

Figure 1:
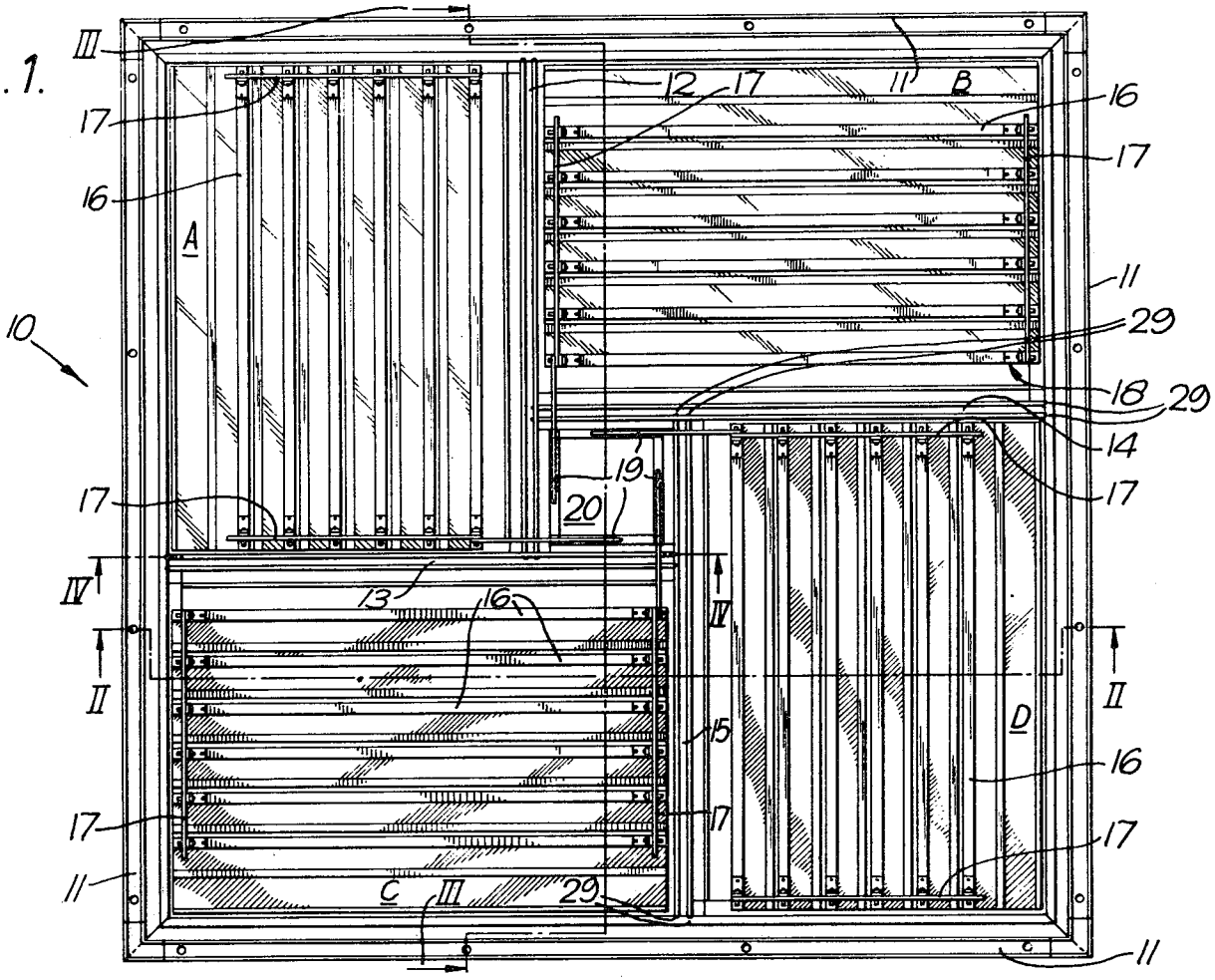
FIG. 1 represents a plan view of the air outlet assembly constructed in accordance with the invention.
Figure 2:
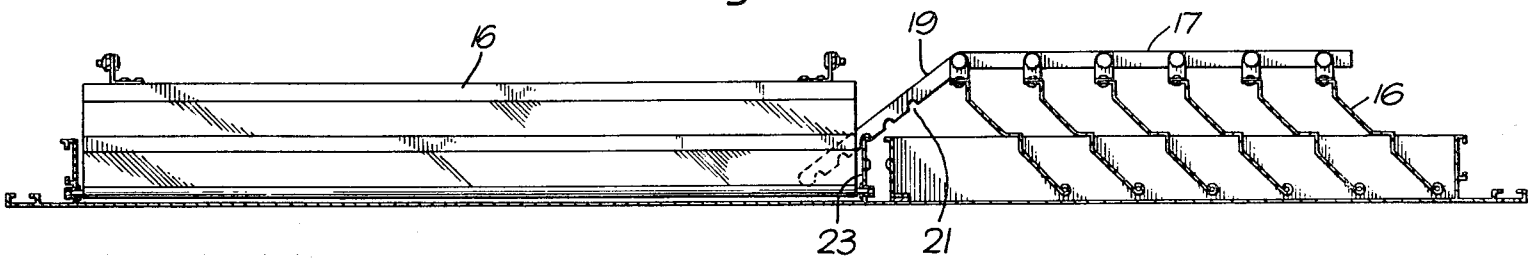
FIG. 2 represents a view along line II—II of FIG. 1, illustrating the manual adjustment means for setting the louvre assemblies.
Figure 3:
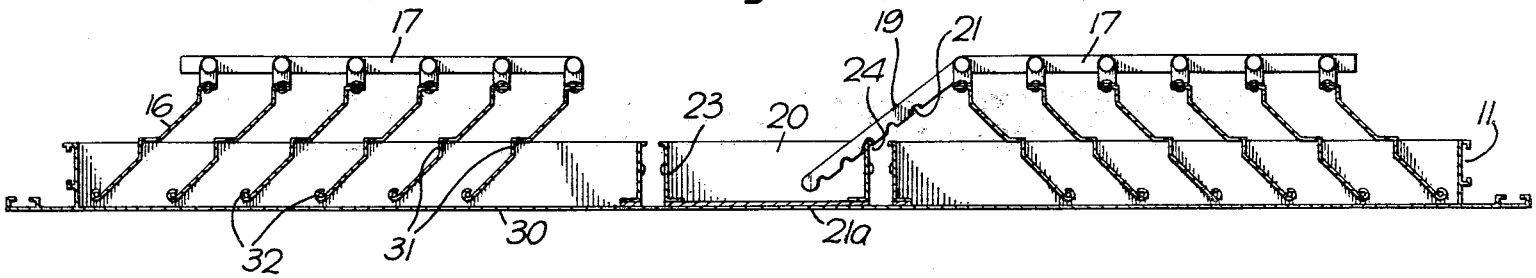
FIG. 3 represents a view along line III—III of FIG. 1, illustrating oppositely arranged louvre assemblies.
Figure 4:
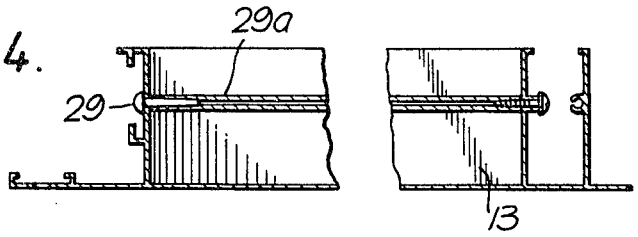
FIG. 4 represents a view along line IV—IV of FIG. 1, showing the means for interconnecting the frame parts.
Figure 5:
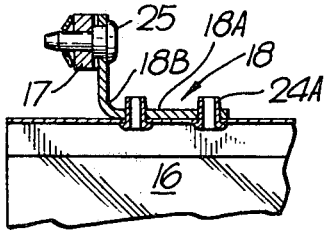
FIG. 5 represents a detailed view of the pivotal attachment between a connecting bar and adjacent louvre blade.
Figure 6:
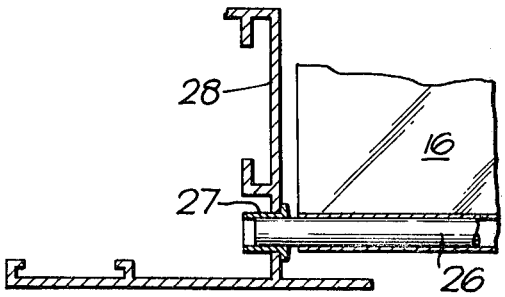
FIG. 6 represents a detailed view of the pivotal attachment between a louvre blade and adjacent frame member.

Referring to FIGS. 1 to 6 there is shown air outlet assembly 10 comprising louvre sub-assemblies A,B, C and D attached to a support frame including peripheral frame members 11 and interconnecting frame members 12, 13, 14 and 15 which together with frame members 11 form subframes supporting an associated louvre sub-assembly.

Each louvre sub-assembly includes louvre blades 16 connecting rods or bars 17, attached to blades 16 by connecting plates 18 and a latch member 19. Each latch member 19 has notches 21 for engaging with retaining flange or top edge 24 of walls 23 of access aperture 20 which has cover plate 21*a*.

The screws 29 are used for engagement within cross members 29*a* for securing together the frame members. The connection plate 18 has a vertical flange 18B and horizontal flange 18A. The plate 18 is attached to louvre blade 16 by bolts 24A while vertical flange 18B is attached to connection rod 17 by pivot pin 25.

Each louvre blade 16 is attached to an adjacent frame member 28 by pivot pin 26 rolled into the edge portion of the blade 16 and engaging in a bushed aperture 27 in the member 28.

In the drawings the louvre blades 16 are shown in their open setting however they can, of course, pivot to a closed setting at which they lie substantially flush with the bottom 30 of the frame 11. In this position the stiffing ridges 31 extending centrally along the louvre blades 16 overlie the rolled side portions 32 in which the pivot pins 26 are supported.

In use, a desired setting of any one of the louvre assemblies A, B, C, or D may be achieved independent of the remaining louvre assemblies by manually manipulating the latch member 19 to engage a selected one of the notches 21 about the top edge of the wall 23. Thus each louvre assembly may be adjusted to the fully open position whereby the air forced through the air outlet assembly 10 is evenly distributed in the four directions towards say each corner portion of a room. Alternately if it is desired to supply a reduced draft to one corner portion of a room, then the louvre assembly which deflects the air draft towards that area may be adjusted by lowering the louvre blades towards their closed position to impede the flow of air therethrough towards that selected area.

In an alternate form remote operation of the louvre blades may be effected by say a co-axial cable actuator adapted to raise or lower a common yoke operatively connected to the bars 17. The yoke may have a proporting device whereby lifting of the yoke may cause differential actuation of the louvre assemblies.

Figure 7:
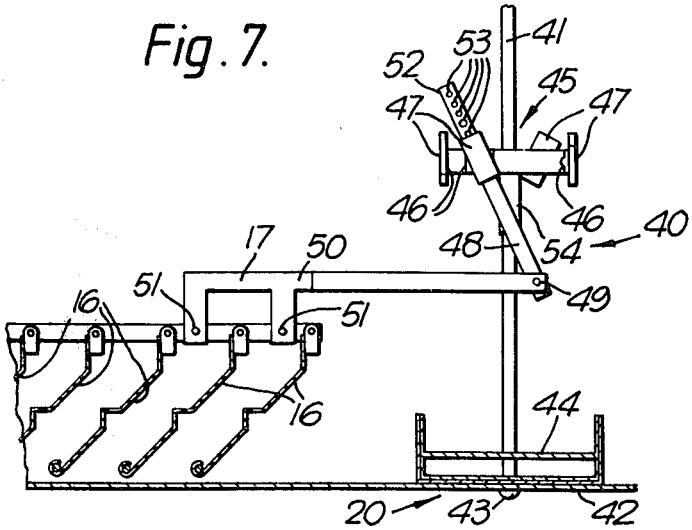
FIG. 7 illustrates the central portion of a further embodiment of the invention showing the adjustable connection of a louvre assembly to a control operating mechanism.
Figure 8:
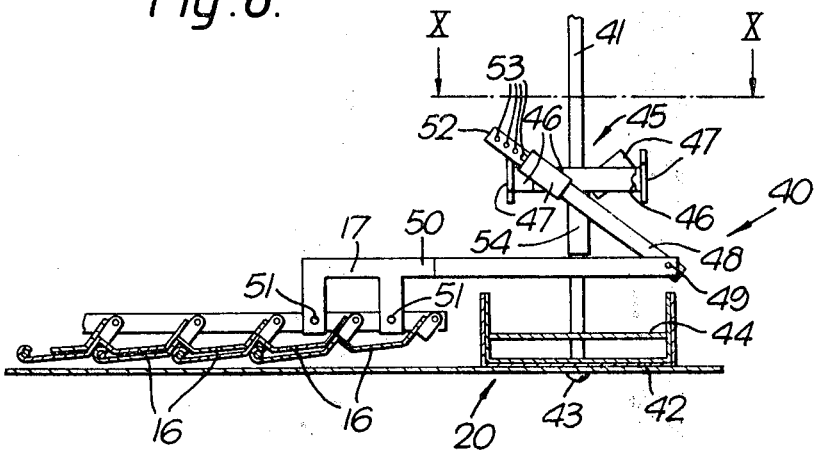
FIG. 8 is a view similar to FIG. 7 but showing the louvre blades in their closed position.
Figure 9:
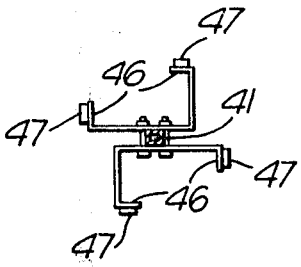
FIG. 9 is a plan view of the central control means.

In yet a further embodiment of the invention as illustrated in FIGS. 7-9 there is shown means 40 for simultaneously actuating the louvre assemblies by remote control such that each louvre assembly may be moved from the closed position to a selected open position which may vary between the respective louvre assemblies. In the illustrated embodiment there is provided a central guide bar 41 having a square cross-sectional configuration and supported by a socket member 42 which fits into the centre opening 20. This bar 41 is screwed at 43 to the socket member 42 and passes through a corresponding square aperture in the fixed bar 44 so that it is supported against rotation. A slider assembly 45 is freely slidable along the bar 41 and provides respective pivotal mountings 46 for four guide members 47 connected pivotally thereto. Each guide member 47 is adapted to slideably receive an actuating bar 48 which is pivotally connected at its lower end at 49 to an extension member 50 connected rigidly to the connecting bar 17 by the pinned sections 51. The upper end 52 of the actuating bar 48 is provided with a series of spaced apertures 53 through which a stop pin may be inserted for adjustment of the open setting of the respective louvre assembly.

As shown in FIG. 8 when the slider assembly 45 is in its lowermost position the louvre blades 16 are in their closed position. As the slider assembly 45 is elevated the guide member 47 will firstly contact the stop pin in the lowermost apertures and will commence to open the louvres. If say one stop pin is positioned in the uppermost apertures of the series of apertures 53 then the louvre assembly controlled thereby will not begin to open until further elevation of the slider assembly 45. When the latter is at its uppermost position the louvre assembly associated with the control arm 48 with the pin in the uppermost aperture 53 will be opened at a lesser extent than the louvres associated with the control arms 48 with their stop pins in a respective lower aperture 53. Thus by positioning the stop pin in a selected aperture 53 the fully open position of the respective louvre assemblies may be individually controlled.

The slider assembly 45 may be raised and lowered along the shaft 41 by say a co-axial cable having control means mounted remote from the outlet assembly. Alternately the slider assembly 45 may be interconnected with an electrical drive means selectively operable to reciprocate the slider assembly 45 along the guide arm 41 and a remote double action switch may be provided to enable the outlet assembly to be actuated to the open or closed position. It is preferred that in the electrical actuated version that means be provided to energise the drive motor to open the louvre assemblies upon switching on the air supply means. Thus if the air supply means is an electric fan, the fan cannot be operated with the louvre assembly in the closed attitude. This would, of course, cause overheating and damage to the electric fan. Alternately, the slider assembly 45 could be in the form of a threaded bar to threadedly engage with the body 54 of the slider assembly 45 whereby rotation of the shaft 41 would cause the slider assembly 45 to move therealong. Such rotation could be achieved manually by a handle projecting downwardly from the shaft 41 beneath the outlet assembly or by an electric motor or by cable drive means connected directly to the top of the shaft 41.

From the above it will be seen that the louvre assemblies may be preset so that upon remote actuation of the outlet assembly the respective louvre assemblies will open to a predetermined extent to supply regulated air to respective areas. If in use, the need for the air supply to a particular area diminishes or increases the setting for the particular louvre assemblies may be easily varied to suit by simply changing the position of the stop bars inserted in the respective apertures 53 in the control arm 48. Of course, the manual adjustment described above could be replaced by electrical drive adjustment means such that remote operation of the adjustment means could be provided to enable say instaneous variations of one louvre assembly independent of the remaining louvre assemblies. This could also be achieved by separate control motors operably to raise and lower respective louvre assemblies.

Furthermore, an air outlet assembly according to this invention may include a plurality of blade assemblies arranged to deflect air in different directions and selected blade assemblies may be fixed or movable as desired to enable the flow therethrough to be selectively adjusted. This could be achieved by pivoting the blades as described above or by providing damper means to control the flow of air to the blades.

It will, of course, be realised that while the above has been given by way of illustrated example of the invention all such modifications and variations thereto as would be apparent to persons skilled in the art and deemed to fall within the broad scope and ambit of the present invention as is defined in the appended claims.

I claim:

1. A multi-directional air outlet assembly including a plurality of louvre assemblies each comprised of a plurality of parallel pivoted louvre blades and each operable by common control means between a closed attitude and an open attitude for deflecting air flow through said outlet assembly for simultaneous discharge, said blades of each assembly being disposed at an angle to said blades of each adjacent assembly so that air discharge from each assembly is in a different direction to air discharge from an adjacent assembly, said common control means being so interconnected to said louvre assemblies that upon actuation of said common control means each said louvre assembly will be opened from its closed attitude to a preselected extent.

2. A multi-directional air outlet assembly according to claim 1, wherein each said louvre assembly is interconnected to said common control means by respective actuating means each of which is selectively adjustable.

3. A multi-directional air outlet assembly according to claim 2, wherein each said actuating means includes a linkage adjustably secured to said control means.

4. A multi-directional air outlet assembly according to claim 3, wherein said linkage is provided with selectively variable lost motion connection means to said control means.

5. A multi-directional air outlet assembly according to claim 1 wherein said louvre assemblies are supported within a common support frame and said control means is disposed substantially centrally within said frame.

6. A multi-directional air outlet assembly according to any one of the preceding claims, wherein there are provided four substantially identical louvre assemblies with said blades of each assembly being disposed at right angles to said blades of each adjacent assembly to deflect air for discharge in a direction substantially at right angles to the direction of discharge from the adjacent louvre assemblies.

7. A multi-directional air outlet assembly according to claim 6, wherein said louvre assemblies are supported within a rectangular support frame and provide respective air flow zones adjacent each corner portion of said frame and a central non-flow zone therebetween at which said control means is disposed.

8. A multi-directional air outlet assembly according to claim 7, wherein said louvre assemblies each include a plurality of blades pivotal about respective axes disposed in a common plane.

9. A multi-directional air outlet assembly according to claim 8, wherein said control means includes an actuator reciprocably mounted on a beam supported centrally of said support frame and extending at right angles to said common plane and there being provided means for remote operation of said actuator.

* * * * *